US006918380B2

(12) United States Patent
Nomura

(10) Patent No.: US 6,918,380 B2
(45) Date of Patent: Jul. 19, 2005

(54) FUEL INJECTION APPARATUS FOR MARINE ENGINE

(75) Inventor: Kenichi Nomura, Kawasaki (JP)

(73) Assignee: Keihin Corporation, Tokyo (JP)

( * ) Notice: Subject to any disclaimer, the term of this patent is extended or adjusted under 35 U.S.C. 154(b) by 0 days.

(21) Appl. No.: 10/613,894

(22) Filed: Jul. 3, 2003

(65) Prior Publication Data

US 2004/0003797 A1 Jan. 8, 2004

(30) Foreign Application Priority Data

Jul. 5, 2002 (JP) ..... 2002-196624

(51) Int. Cl.[7] ..... F02M 37/04
(52) U.S. Cl. ..... 123/495; 417/423.1
(58) Field of Search ..... 123/495, 516, 123/518, 520; 417/423.1, 423.7, 366, 357, 371

(56) References Cited

U.S. PATENT DOCUMENTS 4,830,576 A * 5/1989 Patrick ..... 417/45
5,092,748 A * 3/1992 Simmons, II ..... 417/423.1

FOREIGN PATENT DOCUMENTS

JP 2001-280211 10/2001

* cited by examiner

*Primary Examiner*—Mahmoud Gimie
(74) *Attorney, Agent, or Firm*—Mark D. Wieczorek, Esq.

(57) ABSTRACT

To provide a fuel injection apparatus preferable for a marine engine which can prevent a metal soap from being generated in a motor portion of a high pressure electric pump even when fuel containing sea water is sucked into the electric pump, a high pressure electric pump (HP) is provided with a pump portion (P) and a motor portion within a pump housing (1), the pump portion (P) sucks fuel within a vapor separator (V), high pressure fuel the pressure of which has been increased by the pump portion (P) is discharged through the periphery of the motor portion, the motor portion of the high pressure electric pump (HP) is formed as a brushless motor portion, and a resin material is molded on the outer periphery of a drive coil (6B) constituting the brushless motor portion, thereby shutting off contact between the drive coil (6B) and the fuel.

1 Claim, 3 Drawing Sheets

FUEL INJECTION APPARATUS FOR MARINE ENGINE

BACKGROUND OF THE INVENTION

1. Field of the Invention

The present invention relates to a fuel injection apparatus used in a marine engine such as an outboard motor for sailing on the sea.

2. Description of Conventional Art

A description will be given of a conventional fuel injection apparatus for the marine engine with reference to FIG. 3.

Reference symbol T denotes a fuel tank in which fuel is stored, reference symbol V denotes a vapor separator within which a fixed fuel liquid surface X—X is formed, and reference symbol D denotes a fuel distribution pipe provided with fuel injection valves J injecting and supplying the fuel into intake pipes K of the engine.

Further, the vapor separator V is structured as follows.

Reference numeral 20 denotes a cup-shaped casing. An upper opening of the casing 20 is closed by a cover 21.

Reference symbol F denotes a fixed liquid surface control mechanism which forms and holds the fixed fuel liquid surface X—X within the vapor separator V. The fixed liquid surface control mechanism F is constituted by a valve seat 23 which is connected to an inflow passage 22 formed in the cover 21 and is open to the inside of the vapor separator V, a float valve 24 which opens and closes the valve seat 23, and a float 26 which is rotatably supported to an axis 25, swings in correspondence to a liquid surface height formed within the vapor separator V, and controls so as to open and close the valve seat 23 via the float valve 24.

Further, a high pressure electric pump HP is arranged within the vapor separator V, and this electric pump HP is constituted by a direct current motor portion DM and a pump portion P. The pump P is structured such that an impeller 31 provided with a plurality of vane grooves in a peripheral edge portion is rotatably arranged within a pump chamber recess portion 30 formed between a first casing 28 and a second casing 29 which are arranged below a cylindrical pump housing 27.

Further, a pump inflow passage 32 and a pump outflow passage 33 are arranged so as to be open to the pump chamber recess portion 30, and the upstream side of the pump inflow passage 32 is open downward and is open within the vapor separator V. On the other hand, the downstream side of the pump outflow passage 33 is open within the pump housing 27 above the first casing 28. (In the following description, the upstream and downstream are described with respect to a flowing direction of the fuel.)

The direct current motor portion DM is constituted by an armature 35 attached to a motor axis 34 both ends of which are rotatably pivoted, a commutator 36 which is attached to the motor axis 34 and is connected to the armature 35, a brush 37 which is in slidable contact with the commutator 36, and a semicylindrical permanent magnet 38 which is arranged inside the pump housing 27 so as to face to the armature 35, and the direct current motor portion DM is arranged inside the pump housing 27.

Further, an upper opening of the pump housing 27 is closed by a pump cover 39, a pump discharge passage 40 is formed in the pump cover 39, the upstream side of the pump discharge passage 40 is communicated with the inside of the pump housing 27 in which the direct current motor portion DM is received, and the downstream side thereof is open toward the outside.

The high pressure electric pump HP provided with the direct current motor portion DM and the pump portion P is shown, for example, in Japanese Patent Publication No. 63-63756.

Further, the electric pump HP is arranged within the vapor separator V, the pump discharge passage 40 is connected to a discharge passage 41 provided in the cover 21, and the pump inflow passage 32 is arranged so as to open below the fixed liquid surface X—X within the vapor separator V via a suction side filter 42.

Further, the fuel injection apparatus of the marine engine is formed in the following manner.

The fuel tank T and the vapor separator V are communicated via a low pressure fuel pump LP. The low pressure fuel pump LP and the fuel tank T are communicated by a low pressure fuel suction passage 43, and the low pressure fuel pump LP and the inflow passage 22 of the vapor separator V are communicated by a low pressure fuel discharge passage 44.

Further, a fuel distribution pipe D and the high pressure electric pump HP are communicated via the high pressure fuel filter HF. The high pressure fuel filter HF and the discharge passage 41 of the cover 21 are communicated by a first high pressure discharge passage 45, and the high pressure fuel pump HF and the fuel distribution pipe D are communicated by a second high pressure fuel discharge passage 46.

Further, a pressure regulator. R is attached to the fuel distribution pipe D, and a return fuel pipe 47 of the pressure regulator R is communicated with the inside of the vapor separator V.

In accordance with the fuel injection apparatus for the marine engine structured in the manner mentioned above, the fuel within the fuel tank T is sucked into the low pressure fuel pump LP via the low pressure fuel suction passage 43, and the fuel the pressure of which is increased to low pressure (for example, 0.3 kg/cm$^2$) by the fuel pump LP is supplied within the vapor separator V via the low pressure fuel discharge passage 44, the inflow passage 22 and the valve seat 23.

In the vapor separator V, the low pressure fuel is supplied, whereby the fuel is stored within the vapor separator V, and the fixed fuel liquid surface X—X is formed and held within the vapor separator V by a fixed liquid surface control mechanism F.

On the other hand, the direct current motor portion DH of the high pressure electric pump HP is rotated and driven, whereby the impeller 31 is also rotated within the pump chamber recess portion 30 by the motor axis 34. In accordance with this structure, the fuel within the vapor separator V is sucked into the pump chamber recess portion 30 via the intake side filter 42 and the pump inflow passage 32, and the high pressure fuel the pressure of which is increased to high pressure (for example, 3 kg/cm$^2$) within the pump chamber recess portion 30 reaches the pump discharge passage 40 via the pump outflow passage 33, and a motor space portion A formed between the direct current motor portion DM and a pump casing 27 surrounding the direct current motor portion DM.

Further, the high pressure fuel in the pump discharge passage 40 is supplied to the high pressure fuel filter HP via the cover discharge passage 41 and the first high pressure fuel discharge passage 45, the high pressure fuel from which foreign materials are removed by the high pressure fuel filter HP is supplied to the fuel distribution pipe D via the second high pressure fuel discharge passage 46, and this fuel is electrically supplied within the intake pipes K via the fuel injection valves J.

On the other hand, when the pressure of the fuel within the fuel distribution pipe D is increased over predetermined pressure, the pressure regulator R releases the return fuel pipe 47, whereby the surplus fuel is again circulated into the vapor separator V via the return fuel pipe 47. Accordingly, it is possible to maintain the fuel having predetermined fuel pressure within the fuel distribution pipe D.

The direct current motor portion DM of the conventional high pressure electric pump HP mentioned above is arranged within the pump housing 27, and the high pressure fuel within the pump housing 27 flowing from the pump portion P toward the pump discharge passage 40 is in contact with the direct current motor portion DM.

That is, the high pressure fuel flows down toward the pump discharge passage 40 while being in contact with the direct current motor portion DM.

This is provided for the purpose of cooling the direct current motor portion DM, lubricating the commutator 36 and the brush 37 and lubricating the motor axis 34 and the bearing portion.

Here, in the case of using the fuel injection apparatus mentioned above as the marine engine, there is a risk that vapor containing sea water and splash of sea water enter into the fuel tank T and the vapor separator V. For example, they possibly enter at a time of connecting the fuel pipe or they possibly enter from an opening portion in an air vent hole of the fuel tank T or the vapor separator V.

Further, when pressure of the fuel (gasoline or fuel mixture of gasoline and engine oil) in which the sea water is mixed as in the case mentioned above is increased by the pump portion P of the high pressure electric pump HP, and the fuel containing the sea water is stirred so as to be brought into contact with the armature 35, the commutator 36 and the brush 37 constituting the direct current motor portion DM, a metal ion such as a calcium, a magnesium or the like contained in the sea water is combined so as to generate a metal soap in some cases.

Further, the metal soap mentioned above is peeled off from the direct current motor portion DM by the high pressure fuel flowing through the periphery thereof, and the metal soap is caught by the high pressure filter HF via the first high pressure fuel discharge passage 45.

In this case, the high pressure fuel filter HF is to be cleaned compulsorily by a driver after a fixed time use, however, if this cleaning is not carried out, there is generated a problem that a flow passage resistance is increased by the high pressure fuel filter HF, and the fuel supply to the fuel distribution pipe D is reduced.

Further, in the case that the cleaning is not carried out for a long time period, there is a risk that a clogging of the high pressure fuel filter HF caused by the metal soap is promoted, and the high pressure fuel filter HF is largely deformed by the high pressure fuel.

Further, in the case that the high pressure electric pump HP is in an unused state for a long time period, an oxide film due to the sea water tends to be generated on an outer peripheral surface of the commutator 36 other than the contact portion of the commutator 36 with a leading end portion of the brush 37, which is not preferable in electric current conduction between the commutator 36 and the brush 37.

Furthermore, an ethanol is often mixed in gasoline fuel in recent years, however, in accordance with this structure, the mixing of the sea water and the gasoline is promoted due to an interposition of an alcohol, and the problem mentioned above is expanded.

Still further, there can be considered a so-called dry motor system in which the direct current motor portion and the pump portion are isolated by a coupling portion, and the fuel the pressure of which is increased by the pump portion is not moved to the direct current motor portion, however, in accordance with this structure, a size of the fuel pump is increased and the number of the parts is largely increased, so that it is not practically preferable.

SUMMARY OF THE INVENTION

A fuel injection apparatus in accordance with the present invention is made by taking the problem mentioned above into consideration, and a first object of the present invention is to provide a fuel injection apparatus preferable for a marine engine which can prevent a metal soap from being generated in a motor portion of a high pressure electric pump even when the sea water enters into fuel within a fuel tank and a vapor separator, and can prevent a filter clogging in a high pressure fuel filter for a long time period.

In order to achieve the object mentioned above, in accordance with the present invention, there is provided a fuel injection apparatus for a marine engine in which pressure of fuel with in a fuel tank is increased in by a low pressure fuel pump, and the fuel is supplied into a vapor separator within which a fixed fuel liquid surface is formed, and in which pressure of fuel within the vapor separator is increased by a pump portion of a high pressure electric pump, and the fuel is supplied toward a fuel injection valve arranged so as to face to the engine through a motor portion arranged within the electric pump, wherein the high pressure electric pump is provided with a pump portion and a motor portion within a pump housing, the motor portion is formed as a brushless motor portion, and the outer periphery of a drive coil in the brushless motor portion fixedly arranged within the pump housing is molded with a resin material.

The motor portion constituting the high pressure electric pump is structured as the brushless motor portion, and the outer periphery of the drive coil constituting the brushless motor portion is molded with the resin material. In accordance with the structure mentioned above, even when fuel containing the sea water flows down within the pump housing, the sea water is not in contact with the electric constituting parts such as the drive coil, and the metal soap is not generated in the electric constituting parts.

Further, since the electric constituting parts are formed by the fixed drive coil, it is possible to extremely easily mold the resin material.

DESCRIPTION OF THE PREFERRED EMBODIMENT

Figure 2:
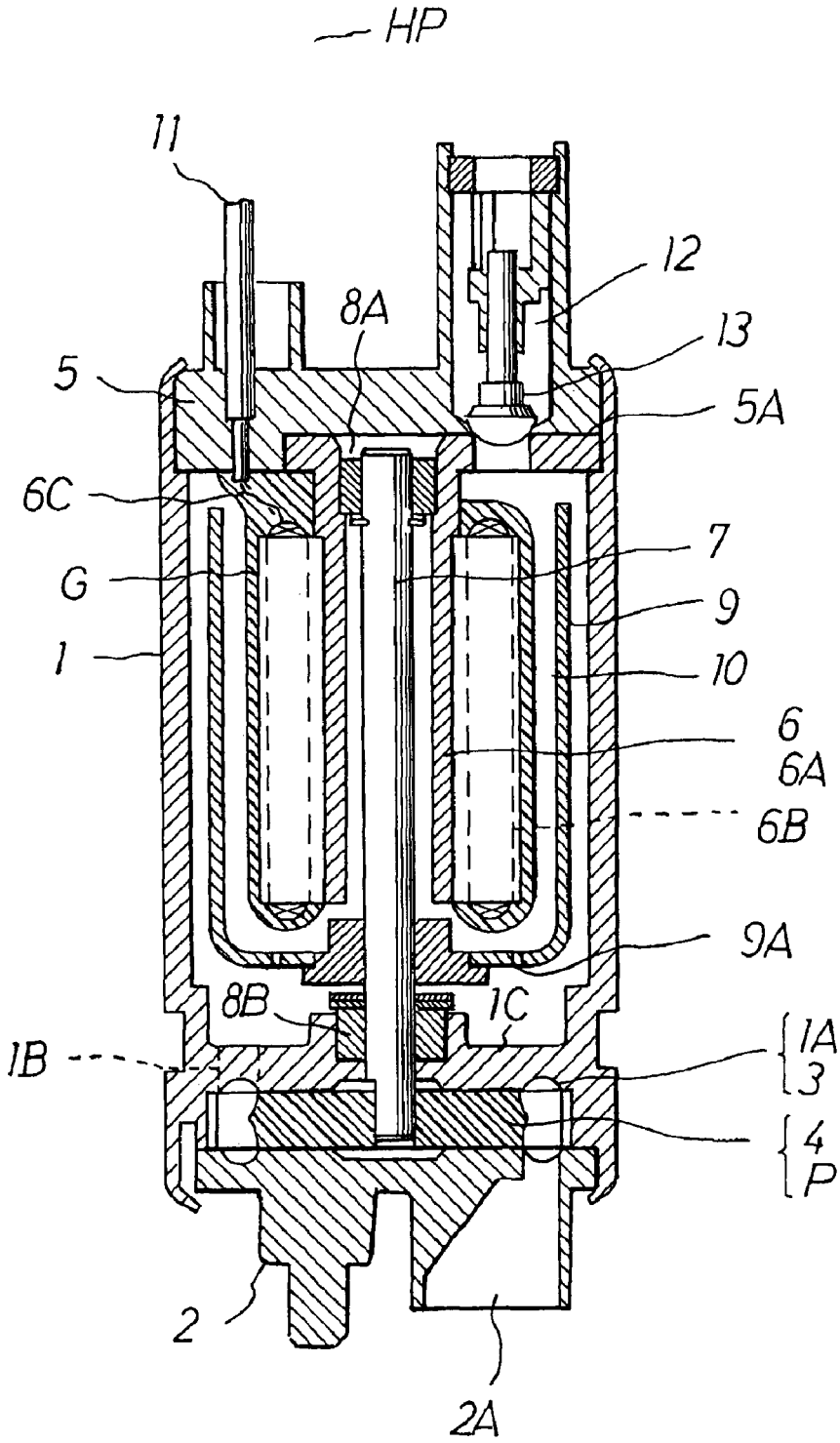
FIG. 2 is a vertical cross sectional view showing one embodiment of a high pressure electric pump used in the embodiment in FIG. 1.
Figure 3:
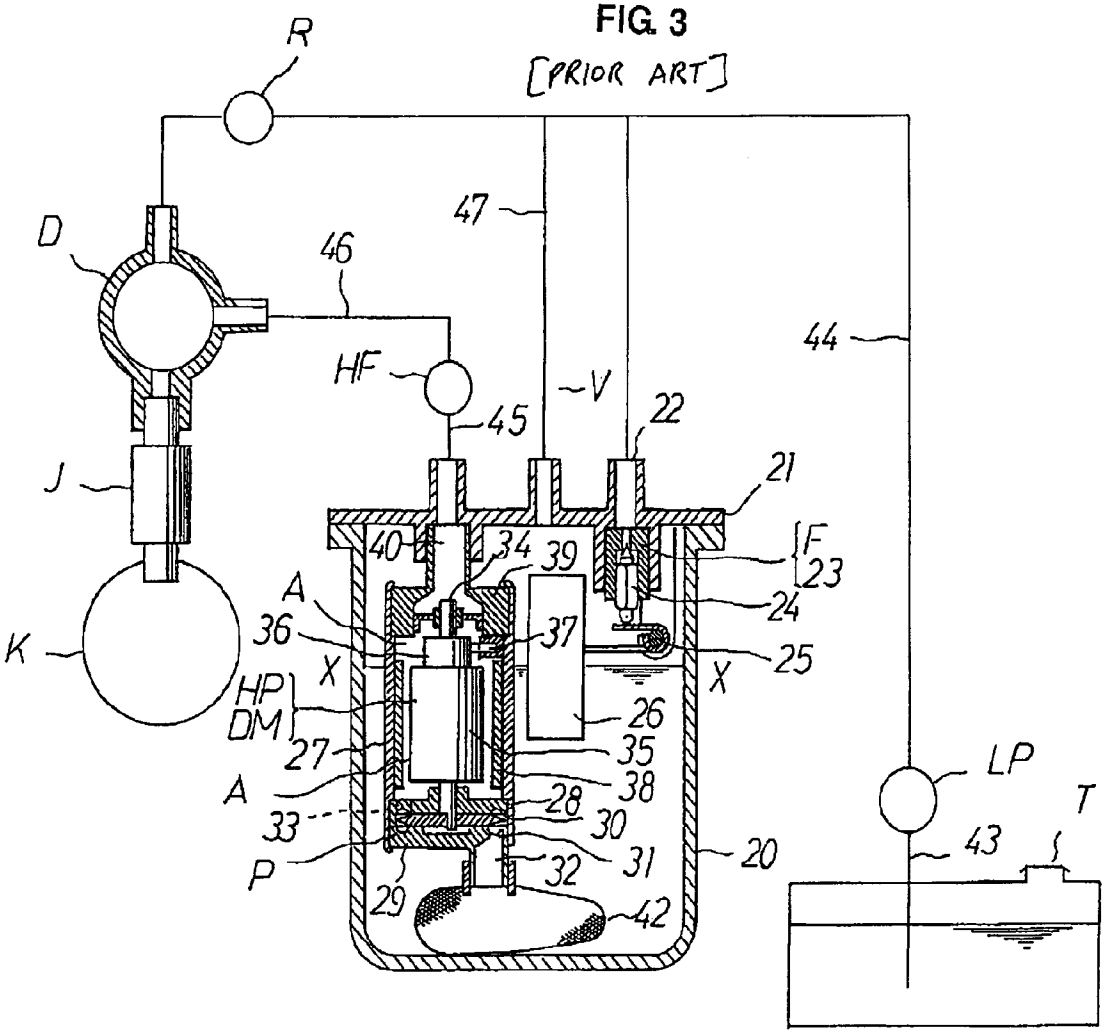
FIG. 3 [PRIOR ART]
FIG. 3 is a schematic view of the whole of a conventional fuel injection apparatus for a marine engine.

A description will be given of a high pressure electric pump HP used in a fuel injection apparatus for a marine engine in accordance with the present invention with reference to FIG. 2.

Reference numeral 1 denotes a pump housing in which a lower bottom portion 1C is open downward via a pump chamber recess portion 1A and the upper side is open. A lower opening of the pump chamber recess portion 1A is closed by a lower casing 2, whereby a pump chamber 3 corresponding to an annular recess portion is formed.

Further, an impeller 4 provided with a plurality of vane grooves is rotatably arranged in a peripheral edge portion within the pump chamber 3, whereby a pump portion P is formed.

In this case, reference symbol 2A denotes a pump inflow passage formed in the lower casing 2. The upstream side thereof is open downward, and the downstream side thereof is open toward the inside of the pump chamber 3. Further, the upstream side of a pump outflow passage 1B formed in the bottom portion 1C of the pump housing 1 is open to the inside of the pump chamber 3, and the downstream thereof is open to the inside of the pump housing 1.

Further, an upper opening of the pump housing 1 is closed by a pump cover 5, and a field core 6 is firmly fixed to a lower surface 5A of the pump cover 5 facing to the inside of the pump housing 1.

The field core 6 is formed of a magnetic material, a tubular portion 6A formed in a cylindrical shape is provided so as to stand downward within the pump housing 1 from the lower surface 5A, and a drive coil 6B is wound around the tubular portion 6A.

Reference numeral 7 denotes a motor axis which is rotatably arranged in the inside of the tubular portion 6A. The upper side of the motor axis 7 is rotatably supported to a base portion of the tubular portion 6A by a first bearing 8A, and the lower side of the motor axis 7 is rotatably supported to the bottom portion 1C of the pump housing 1 through the tubular portion 6A via a second bearing 8B.

Further, the lower end of the motor axis 7 enters into the pump chamber 3, and the lower end of the motor axis 7 is inserted to a D-cut hole in the impeller 4, whereby a rotation of the motor axis 7 is transmitted to the impeller 4, and the motor axis 7 and the impeller 4 synchronously rotate. Reference numeral 9 denotes a cup body which is integrally formed with the motor axis 7 in a cup shape. The cup body 9 is arranged along the drive coil 6B, and an annular magnet rotor 10 facing to the drive coil 6B with a gap is integrally arranged in the inside of the cup body 9. That is, when the motor axis 7 rotates, the cup body 9 synchronously rotates with the motor axis 7, whereby the magnet rotor 10 rotates so as to face to the outer periphery of the drive coil 6B.

In this case, reference symbol 9A denotes a through hole pierced in the lower side of the cup body 9. Further, a wire C extended from the drive coil 6B is connected to a lead wire 11 arranged so as to pass through the pump cover 5, and an electric signal is input to the drive coil 6B from the lead wire 11.

Further, a pump discharge passage 12 provided in the pump cover 5 is communicated toward the inside of the pump housing 1, and in the pump discharge passage 12, there is arranged a check valve 13 which allows a fuel flow from the inside of the pump housing 1 toward the inside of the pump discharge passage 12 and inhibits a fuel flow from the pump discharge passage 12 toward the inside of the pump housing 1.

In accordance with the structure mentioned above, the motor portion is formed as a brushless motor portion by the field core 6, the drive coil 6B and the magnet rotor 10, and the brushless motor portion is rotatably driven by a control circuit constituted by a Hall device drive circuit, a Hall voltage amplifier circuit, a three-phase logic and drive circuit.

In this case, the brushless motor portion is known, and is structured by molding a resin material on the outer periphery of the drive coil 6B and the wire 6C corresponding to a fixed portion of the brushless motor portion in accordance with the present invention.

Figure 1:
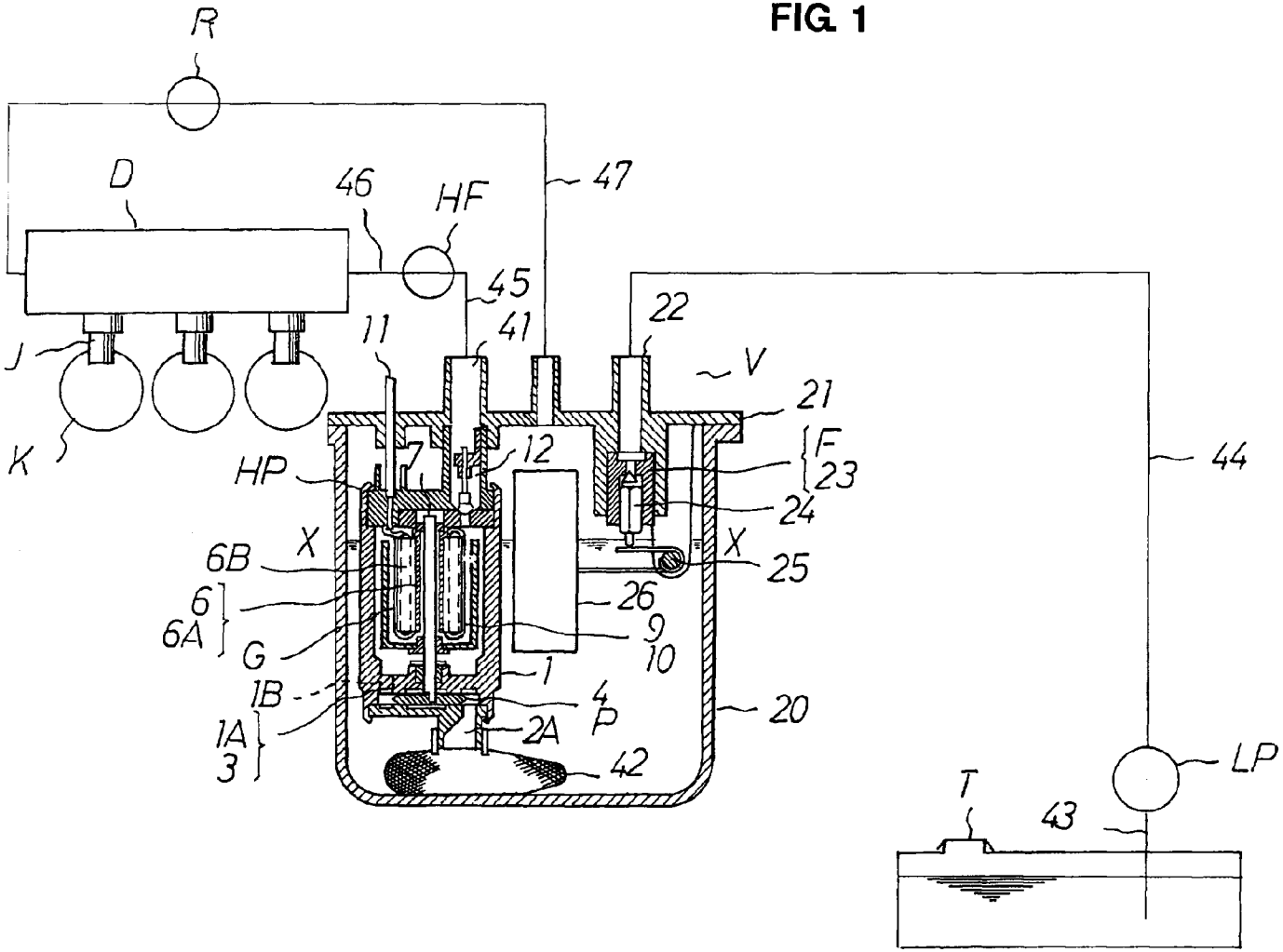
FIG. 1 is a schematic view of the whole showing one embodiment of a fuel injection apparatus for a marine engine in accordance with the present invention.

Then, the high pressure electric pump HP provided with the pump portion P and the brushless motor portion within the pump housing 1 is arranged within the vapor separator V in the same manner as the conventional one, and this is shown in FIG. 1.

In this case, the same reference symbols are used in the same structure portions as those of the prior art, and a description thereof will be omitted.

Next, a description will be given of an operation thereof.

In the case of driving the marine engine, when an electric signal is input to the drive coil 6B via the lead wire 11 and the wire 6C, and the cup body 9 including the magnet rotor 10 rotates, the rotation is transmitted to the motor axis 7, and the motor axis 7 rotates synchronously with the cup body 9.

On the other hand, in accordance with the rotation of the motor axis 7, this rotation is transmitted to the impeller 4 and the impeller 4 synchronously rotates, and in accordance with the rotation of the impeller 4, the fuel within the vapor separator V is sucked from the pump inflow passage 2A into the pump chamber 3, and the fuel the pressure of which has been increased within the pump chamber 3 is discharged into the pump housing 1 via the pump discharge passage 1B.

Then, the fuel the pressure of which has been increased within the pump housing 1 lubricates the bearing portion of the motor axis 7 as well as cooling the drive coil 6B, and the fuel the pressure of which has been increased is discharged from the inside of the pump housing 1 toward the pump discharge passage 12.

Further, the fuel is supplied to the fuel distribution pipe D via the first high pressure fuel discharge passage 45, the high pressure fuel filter HF and the second high pressure fuel discharge passage 46, and this fuel is injected and supplied into the intake pipes K via the fuel injection valves J.

In this case, the fuel injection apparatus for the marine engine in accordance with the present invention is characterized in that the brushless motor portion is used as the motor portion of the high pressure electric pump, and the portion in the drive coil 6B of the brushless motor portion exposed so as to face to the inside of the pump housing 1 is molded with the resin material.

In accordance with the structure mentioned above, since it is possible to completely shut off the contact between the drive coil 6B and the fuel even when the fuel containing the sea water passes through the inside of the pump housing 1, it is possible to completely inhibit the metal soap from being generated in the motor portion.

Accordingly, it is possible to prevent the clogging generated by the metal soap in the high pressure fuel filter HF, it is possible to secure a filter function of the high pressure fuel filter HF for a long time period, and it is possible to largely extend a maintenance timing for the high pressure fuel filter HF.

Further, since it is possible to keep the drive coil 6B in a non-contact state with the fuel even at a stop time of the engine, it is possible to inhibit the metal soap from being generated even when the motor is not used for a long time period, and a motor function is not deteriorated.

Further, in the case of using the brushless motor portion, since it is possible to hold the electric parts of the motor portion in a fixed state, it is possible to extremely easily mold the resin material and the resin material is not abraded due to the rotation.

In this case, the effect mentioned above can be further improved by molding the wire 6C communicating the drive coil 6B with the lead wire 11 with the resin material.

Further, the motor portion may be formed as a stepping motor in place of the embodiment mentioned above, and the high pressure electric pump HP may be arranged outside the vapor separator V.

As mentioned above, in accordance with the fuel injection apparatus for the marine engine on the basis of the present invention, since the brushless motor portion is used as the motor portion of the high pressure electric pump which sucks the fuel within the vapor separator so as to discharge, and the outer periphery of the drive coil constituting the brushless motor portion is molded with the resin material, it is possible to completely shut off the contact between the fuel containing the sea water flowing within the pump housing and the drive coil, whereby it is possible to inhibit the metal soap from being generated in the drive coil corresponding to the electric part.

Accordingly, the metal soap is not mixed into the fuel discharged from the high pressure fuel pump, whereby it is possible to extend the maintenance timing as well as securing the filter function of the high pressure fuel filter for a long time.

Further, since the brushless motor is used, the drive coil is arranged in the fixed state, so that the resin material can be easily molded on the drive coil and the resin material is not abraded at a time of the rotation of the motor.

Further, since the resin material is only molded on the outer periphery of the drive coil in comparison with the conventional brushless motor, the size of the electric motor is not increased, and can be easily put into practice.

What is claimed is:

1. A fuel injection apparatus for a marine engine in which pressure of fuel within a fuel tank is increased in by a low pressure fuel pump, and said fuel is supplied into a vapor separator within which a fixed fuel liquid surface is formed, and pressure of fuel within the vapor separator is increased by a pump portion of a high pressure electric pump, and said fuel is supplied toward a fuel injection valve arranged so as to face to the engine through a motor portion arranged within the electric pump, wherein said high pressure electric pump is provided with a pump portion and a motor portion within a pump housing, said motor portion is formed by a field care which is fixedly arranged to the pump housing and provided with a tubular portion, a drive coil which is wound around an outer periphery of the field core and provided with a wire toward a lead wire, and a magnet rotor, which rotates synchronously with a motor axis and is arranged inside a cup body arranged around the outer periphery of the drive coil, and wherein the outer periphery of the drive coil and the wire which is exposed to the inside of the pump housing are molded with a resin material.

* * * * *